US006520356B2

(12) United States Patent
Miller, Jr.

(10) Patent No.: US 6,520,356 B2
(45) Date of Patent: Feb. 18, 2003

(54) DOUBLE SOCKET PRODUCT MERCHANDISING DISPLAY UNIT

(75) Inventor: Donald J. Miller, Jr., Belleville, IL (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 09/892,338

(22) Filed: Jun. 27, 2001

(65) Prior Publication Data

US 2002/0000418 A1 Jan. 3, 2002

Related U.S. Application Data

(60) Provisional application No. 60/214,397, filed on Jun. 28, 2000.

(51) Int. Cl.[7] ..... A47F 5/00

(52) U.S. Cl. ..... 211/188; 211/186; 211/133.1; 211/126.2; 108/106

(58) Field of Search ..... 211/188, 194, 211/186, 133.1, 126.2, 187; 108/106

(56) References Cited

U.S. PATENT DOCUMENTS

| | | | | | |
|---|---|---|---|---|---|
| 2,654,487 | A | * | 10/1953 | Degener | |
| 3,964,810 | A | * | 6/1976 | Murphy | 211/188 |
| 4,187,786 | A | * | 2/1980 | Feig et al. | 211/188 X |
| 4,467,927 | A | * | 8/1984 | Nathan | 211/188 X |
| 4,930,643 | A | | 6/1990 | Flum | |
| 4,981,224 | A | * | 1/1991 | Rushing | 211/194 X |
| D336,408 | S | | 6/1993 | Tersch et al. | |
| 5,218,914 | A | * | 6/1993 | Dickinson | |
| 5,370,245 | A | | 12/1994 | Tersch et al. | |
| 5,588,541 | A | * | 12/1996 | Goetz | 211/188 |
| 5,624,042 | A | | 4/1997 | Flum et al. | |
| D383,014 | S | * | 9/1997 | Sagol | |
| 6,202,867 | B1 | * | 3/2001 | DiBlasi et al. | 211/188 |

* cited by examiner

*Primary Examiner*—Robert W. Gibson, Jr.
(74) *Attorney, Agent, or Firm*—Blackwell Sanders Peper Martin LLP

(57) ABSTRACT

A product merchandising display unit capable of being both vertically and horizontally arranged to achieve a wide variety of different modular configurations includes plurality of substantially similar shelf members, a plurality of support members, and a plurality of full sockets and partial sockets associated with the upper and lower portions of each of the shelf members for cooperatively engaging the support members. Any number of shelf members can be vertically stackably arranged one above the other by attaching the support members to the full sockets associated with each respective shelf member. In the case where two shelf members are positioned in side-by-side relationship one adjacent the other, such adjacent shelf members can be joined along their abutting edge portions by attaching the support members to aligned pairs of the partial sockets associated with the respective shelf members. In another embodiment, sockets having split channels associated therewith are used instead of separate full and partial sockets in order to achieve the vertical and horizontal arrangements of adjacent shelf members, each split socket combining the features of a full and partial socket into a single socket.

40 Claims, 8 Drawing Sheets

DOUBLE SOCKET PRODUCT MERCHANDISING DISPLAY UNIT

CROSS REFERENCE TO RELATED APPLICATION

This application claims the benefit of U.S. Provisional Application Ser. No. 60/214,397 filed Jun. 28, 2000.

FIELD OF THE INVENTION

This invention relates generally to storage and display devices for use in storing and merchandising shelved products and, more particularly, to a display unit which can be arranged to achieve almost any desired number of vertically disposed shelf members and which can likewise be horizontally arranged to achieve substantially any side-by-side configuration.

BACKGROUND OF THE INVENTION

In our modern culture, the diversity and complexity of consumer goods have become extensive, and this increased diversity and complexity have created a need for more versatile display units which permit the addition and removal of shelves and the joining of adjacent display units. Known display units for storing and merchandising multiple products utilize upright support members to vertically stack shelves in spaced relationships one above the other, and a wide variety of connection mechanisms are used to attach the shelves to the upright members. Some connection mechanisms, such as those disclosed in U.S. Pat. No. 4,930,643, which is hereby fully incorporated herein by reference, permit adjacent units to be arranged and joined in a multitude of desired side-by-side modular configurations. While the connection mechanisms of U.S. Pat. No. 4,930,643 permit side-by-side arrangement of display units, these connection mechanisms require the production of unique connection members in addition to the standard elongated support members associated with a particular display unit, which connection members are complex and costly to manufacture. Further, the unique connection members are not used unless adjacent units are, in fact, joined together in a particular side-by-side configuration. Thus, the cost of manufacturing the unique connection members may be wasted if two units are not horizontally joined together. There is therefore a need for a display unit which is attachable to adjacent display units using standard support members thereby reducing cost and complexity.

BRIEF SUMMARY OF THE INVENTION

There is, therefore, provided in the practice of the present invention a novel display unit which uses standard upright support members for joining both vertically spaced shelf members and horizontally arranged side-by-side shelf members. In one embodiment of the present invention, each shelf member broadly includes a floor portion, a plurality of upper full sockets, a plurality of lower full sockets, and a plurality of upper and lower partial sockets, each partial socket configured to receive a portion of one end portion of a standard elongated support member or other attachment member for attaching one shelf member to an adjacent shelf member having similar upper and lower partial sockets associated therewith. In another embodiment, the upper and lower full and partial sockets may be eliminated and each shelf member may simply include a plurality of upper and lower split sockets as will be hereinafter explained.

The partial sockets of the present invention are each configured to receive a portion of one end of an elongated support member that is normally used with the display unit, the elongated support member serving as the attachment member. Each of the partial sockets includes an outer wall and an inner wall spaced from the outer wall, the inner and outer walls forming an insert and defining a channel for receiving a portion of the elongated support member. The channel is preferably U-shaped and opens at the perimeter edge and top or bottom of the shelf member side wall. Each shelf member may also optionally include mating securement tabs and slots. The securement tabs and slots are preferably T-shaped and further secure the connection between adjacent shelf members. Alternatively, tapered keeper members may also be used to further secure adjacent shelf members. The full sockets, partial sockets, securement tabs, and securement slots are preferably all integrally formed with the shelf members.

It is further contemplated in the practice of the present invention that a plurality of the described shelf members are interconnected to form a display unit according to the teachings of the present invention. A plurality of substantially identical elongated support members are provided to connect the shelf members of discrete display units in vertically spaced arrangements and to connect adjacent shelf members in a multiplicity of side-by-side modular configurations. The support members include hollow end portions to receive the inserts of the partial sockets.

It is still further contemplated in the practice of the present invention that a plurality of the described shelf members and a plurality of the described support members are used in a method of assembling the display unit according to one embodiment of the present invention. For example, two bottom shelf members are aligned horizontally in substantially the same plane in a side-by-side relationship with the upper partial sockets on one side wall of each shelf member being positioned in an aligned and abutting relationship with each other. Elongated support members are then attached to the aligned pairs of the upper partial sockets and to the outer full sockets associated with the horizontally arranged shelf members. Two top shelf members are then attached to the upper ends of the elongated support members in a stacked vertically spaced relationship relative to the two bottom shelf members.

To attach another horizontally arranged shelf member or previously assembled display unit to the exemplary unit described above, the elongated support members are detached from the full sockets along a common edge adjacent the third display unit or other shelf member. The third display unit or other horizontally arranged shelf member is then aligned in abutting relationship with the existing unit to form pairs of upper and lower partial sockets, and the detached elongated support members are then reattached to the aligned pairs of partial sockets associated with the adjacent common edge portions of the horizontally arranged units. Additional support members are then attached to the outer full sockets of the third display unit or other horizontally arranged shelf member.

BRIEF DESCRIPTION OF THE DRAWINGS

These and other inventive features, advantages, and objects will become apparent to those skilled in the art after considering the following specification in connection with the accompanying drawings in which similar reference characters denote similar elements throughout the several views.

DETAILED DESCRIPTION

Figure 1:
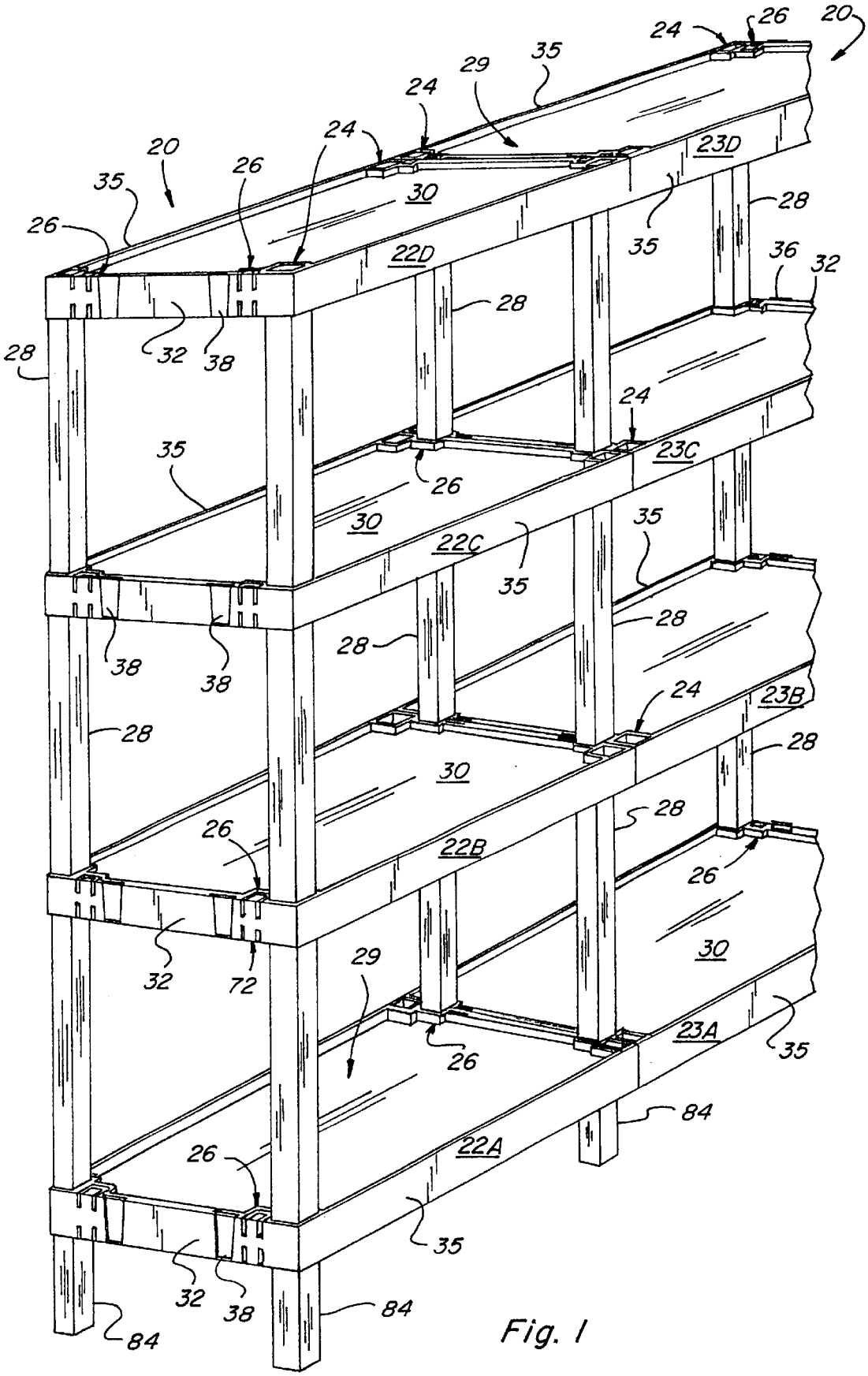
FIG. 1 is a fragmentary perspective view of a pair of interconnected display units constructed and assembled in accordance with the teachings of the present invention.

Referring to the drawings in greater detail, FIG. 1 illustrates a plurality of display units 20 constructed in accordance with one embodiment of the present invention to accommodate the storage of products. Each of the display units 20 includes a plurality of shelf members 22 or 23, each shelf member 22 and 23 having spaced apart full sockets 24 and spaced apart partial sockets 26 interconnected by a plurality of support members 28 received within the sockets 24 and/or 26. The shelf members 22 and 23, and support members 28 are interconnected to vertically stack the shelf members 22 and 23 in a spaced apart relationship in each respective display unit 20. The full and partial sockets 24 and 26 are configured and arranged so that a standard type support member 28 may be used to attach vertically adjoining shelf members 22A, 22B, 22C and 22D using the full sockets 24 and adjacent shelf members 23A, 23B, 23C and 23D using the partial sockets 26.

Figure 2:
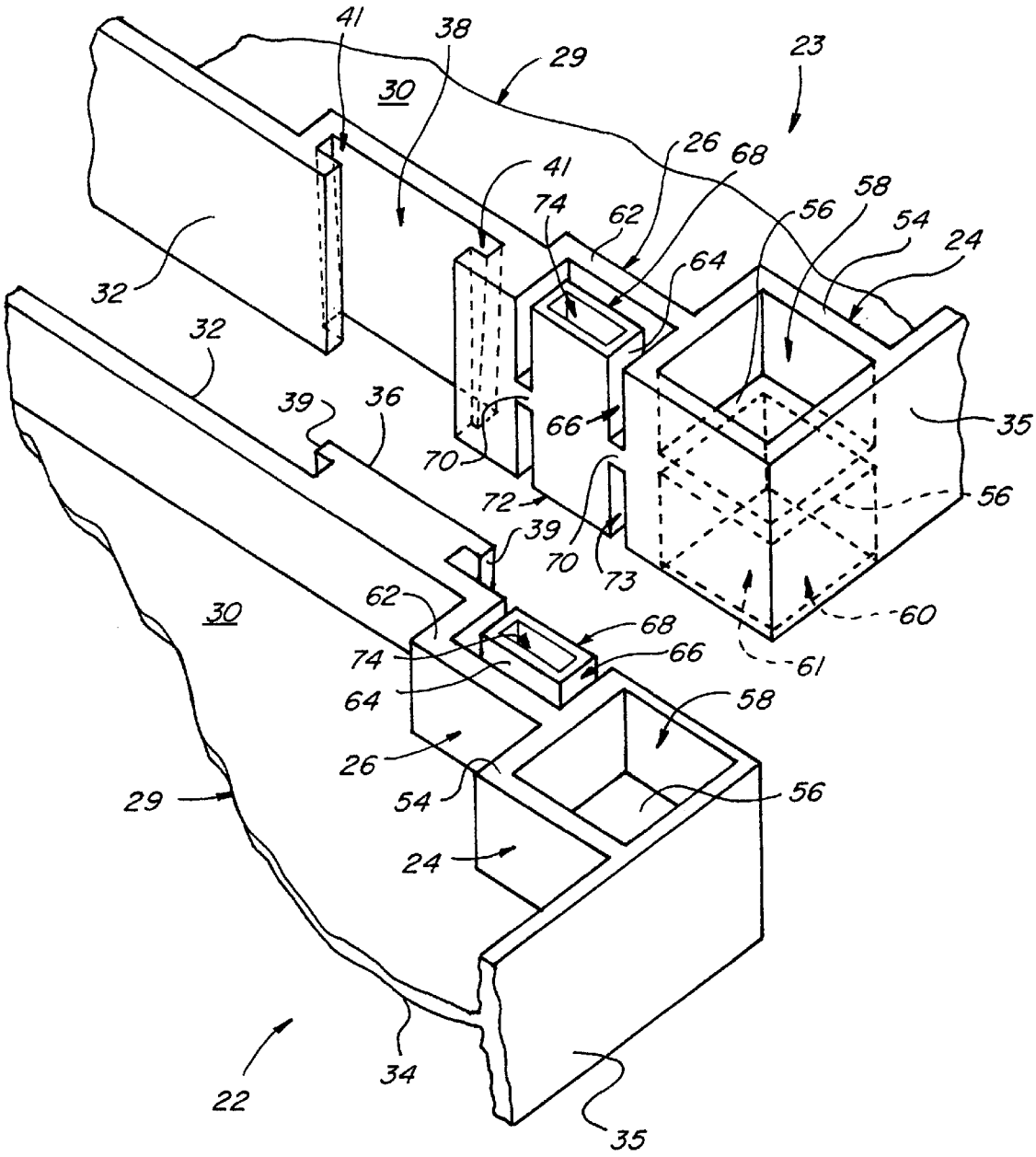
FIG. 2 is a fragmentary exploded perspective view of two adjacent shelf members of FIG. 1.
Figure 3:
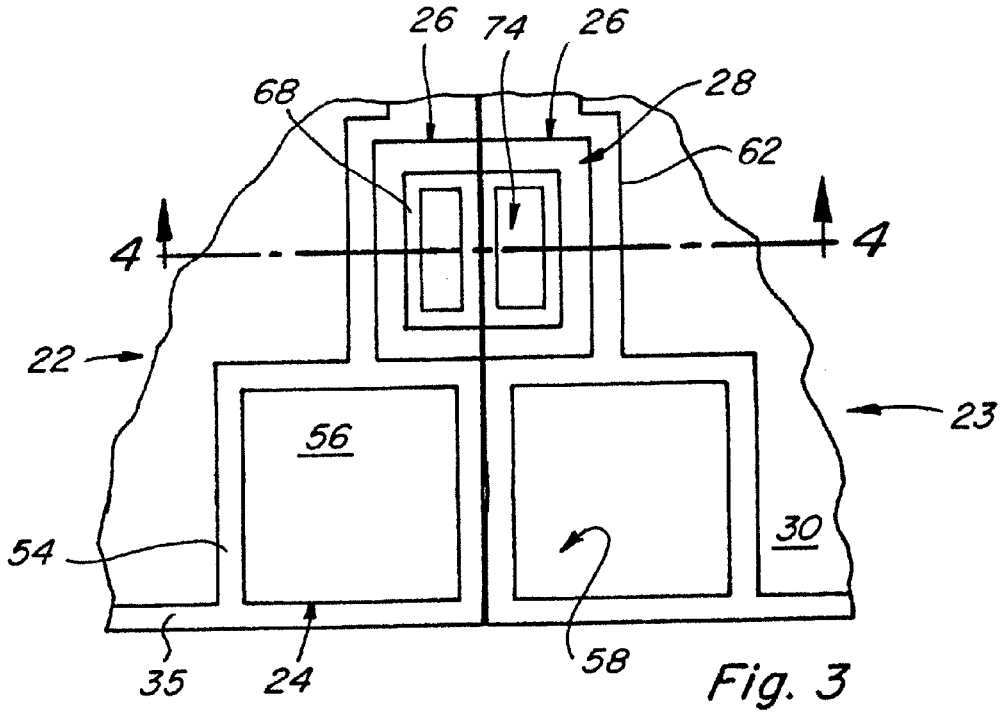
FIG. 3 is a fragmentary top plan view of the shelf members of FIG. 2 connected by a support member.
Figure 4:
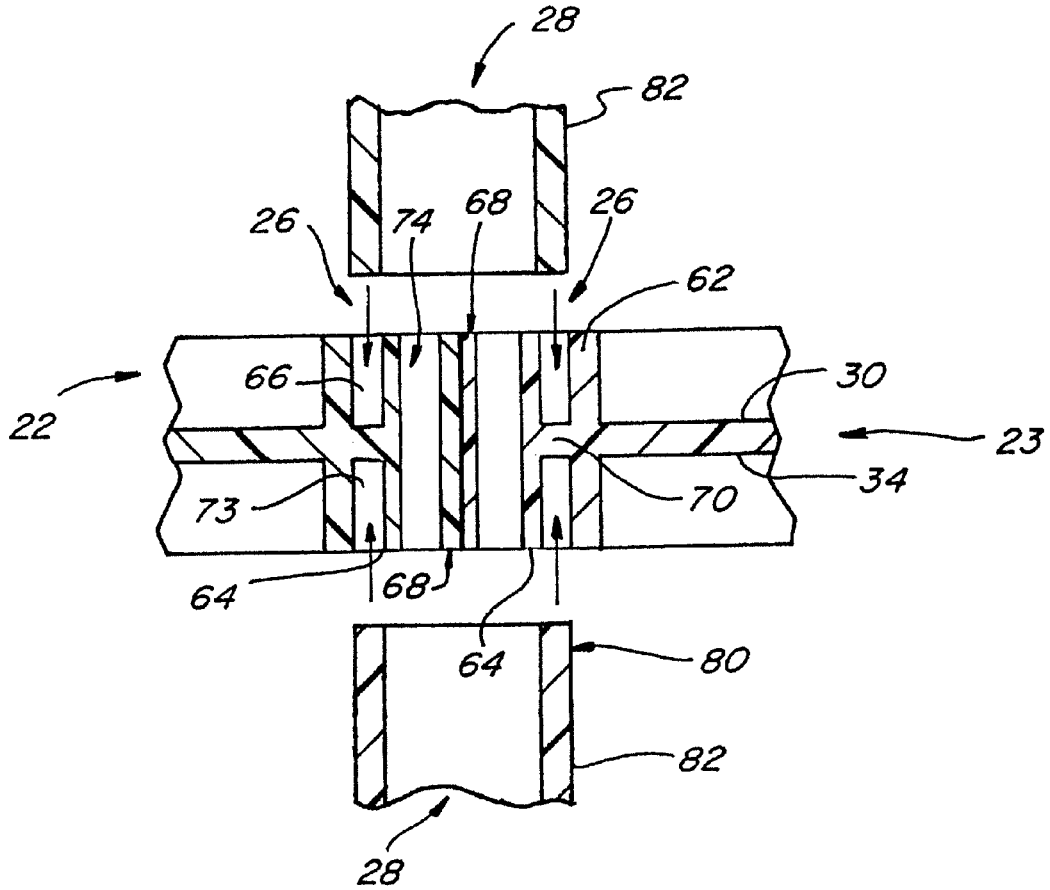
FIG. 4 is an exploded cross-sectional view of the shelf members of FIG. 2 taken along line 4—4 in FIG. 3.

Referring more particularly to FIGS. 2, 3, and 4, each of the respective shelf members 22 and 23, full sockets 24, partial sockets 26, and support members 28 are substantially respectively identical and each will generally be described with reference to only one such members or sockets using identical reference numbers on the related components of each such member or socket. The different levels of shelf members 22 and 23 will be differentiated as necessary by the distinguishing suffixes A,B,C, and D. The shelf members 22 and 23 used to assemble each display unit 20 include a recessed floor member 29 with a substantially rectangular perimeter edge defining four corners, a pair of opposed side walls 32, and a pair of opposed front and rear walls 35. The floor member 29 defines a generally planar upper product support surface 30 which is sufficiently rigid to support desired products. The floor member 29 also includes a recessed lower surface 34 as best shown in FIG. 2, the side walls 32 and 35 extending beyond the upper and lower floor surfaces 30 and 34 to improve the rigidity and stability of the shelf members 22 and 23.

The full sockets 24 are preferably integrally formed with the shelf members 22 and 23, each socket 24 including a perimeter wall 54 forming a cavity 58 adapted to receive and engage a correspondingly shaped end portion associated with support member 28. The socket wall 54 extends downwardly from the top of the side wall to a socket base or bottom wall portion 56 to more fully define the socket cavity 58. Each cavity 58 is shown as being substantially square in shape, although other shapes will work equally as well such as rectangular, circular and so forth. The sockets 24 are dimensioned such that the respective cavities 58 cooperatively or telescopingly receive and engage either end portion of each of the support members 28. The base 56 is substantially parallel to the floor member 29. If desired, the socket wall 54 can be outwardly tapered from the base 56 to the top thereof so that the support member 28 progressively tightens in the socket 24 as it is forced into an abutting relationship with the base 56. Each shelf member 22 and 23 preferably includes four upper full sockets 24 positioned at the four corners of the shelf member and four lower full sockets 60 positioned in axial or opposed alignment with the upper sockets 24. The lower full sockets 60 are substantially similar in construction to the sockets 24 and each include a cavity 61 adapted to receive and engage either end portion of support members 28. The base or bottom wall portion 56 separates the upper and lower cavities 58 and 61. The intermediate wall or base 56 therefore serves as a common locating member and bearing surface for engaging the respective end portions of the support member 28 when such members are positioned within the cavities 56 and 61.

Each partial socket 26 is likewise preferably integrally formed with the shelf members 22 and 23 and each preferably comprises substantially a half socket such that when two half sockets are positioned adjacent each other, a full socket is formed. In the embodiment illustrated in FIG. 2, each half or partial socket 26 includes a three sided outer wall 62 and an insert 68 having an inner wall 64 uniformly spaced from the outer wall 62 to form a U-shaped channel 66. The channel 66 extends around the insert 68 and remains open at the perimeter edge of side wall 32. The inner and outer walls 62 and 64 extend downwardly from the top of the side wall 32 to a separation member or intermediate wall 70 at the bottom of the partial socket 26. If desired, the inner and outer walls can be tapered inwardly so that the socket channel 66 narrows toward the separation 70. In this situation, the support member 28 would progressively tighten in the socket channel 66 as it is forced toward an abutting relationship with the separation member 70. Each shelf member 22 and 23 preferably includes four upper partial sockets 26 and four lower partial sockets 72, the upper and lower partial sockets being in axial or opposed alignment as illustrated such that the separation member 70 separates the upper socket channel 66 from the lower socket channel 73. In this regard, the lower partial sockets 72 are substantially similar in construction to the partial sockets 26, the respective channels 66 and 73 being adapted to receive and engage a portion of either end of support member 28. Here again, the shape of the respective channels 66 and 73 must be compatible with the shape of the respective end portion of the support member 28 for cooperatively receiving the same. The partial sockets 26 and 72 are also preferably positioned adjacent the corners of the shelf member on the respective opposed side walls 32 as best illustrated in FIGS. 1 and 2 and are preferably separated from the corners by at least the dimensions of the full sockets 24 and 60. In this regard, it is recognized and anticipated that any number of partial sockets 26 and 72 may be used in association with side wall 32 as well as side walls 35 if so desired. In addition, inserts 68 may include a central opening 74 extending either partially or all the way through such member for reducing cost and material.

Figure 6:
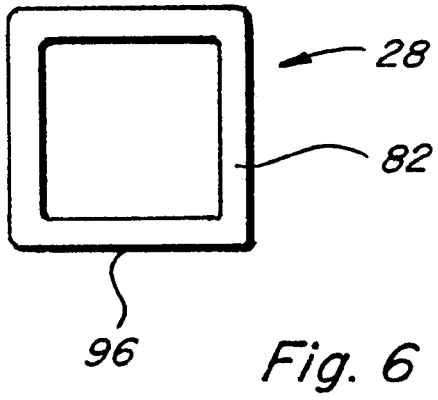
FIG. 6 is an end view of a typical support member which may be used in conjunction with the present invention.

Referring to FIGS. 3, 4, and 6, the substantially rigid support member 28 is an elongated tubular member having a uniform transverse cross section with opposed end portions 80 defined by support member walls 82. The support member walls 82 are of a substantially uniform thickness and are sized to be received in the socket channels 66 and 73 as best shown in FIG. 4. The partial sockets 26 and 72 are sized such that when two such sockets are placed in abutting relationship to each other as illustrated in FIG. 3, the respective channels 66 and 73 mate with each other to form a channel sufficient for receiving either end portion 80 of support member 28. In this regard, the inserts 68 are likewise sized such that two adjacent inserts fill and fittingly mate with either end portion 80 of support member 28. Thus, the support member 28 operates as an attachment member to attach one shelf member to another in side-by-side relationship. If desired, a generally tubular shaped member (not shown) having a cross section compatible with the socket channels 66 and 73 such as the cross sectional shape illustrated in FIG. 6 would also function as an attachment member separate and apart from the support members 28. The height of this separate attachment member is selected such that the member lies flush with the top of the side wall 32 when the member is inserted in the channel slots 66 and/or 73. In this regard, this separate attachment member can be fabricated by merely cutting off a portion of the support member 28 at the appropriate location to achieve the desired height. The outside dimensions of the support member end portions 80 are likewise sized to be received in the full sockets 24 and 60. Legs 84 are also provided to support a bottom shelf member 22A above the ground as shown in FIG. 1. The legs 84 are similar to the support members 28 except that the legs are shorter than the members 28 for obvious reasons.

Figure 5:
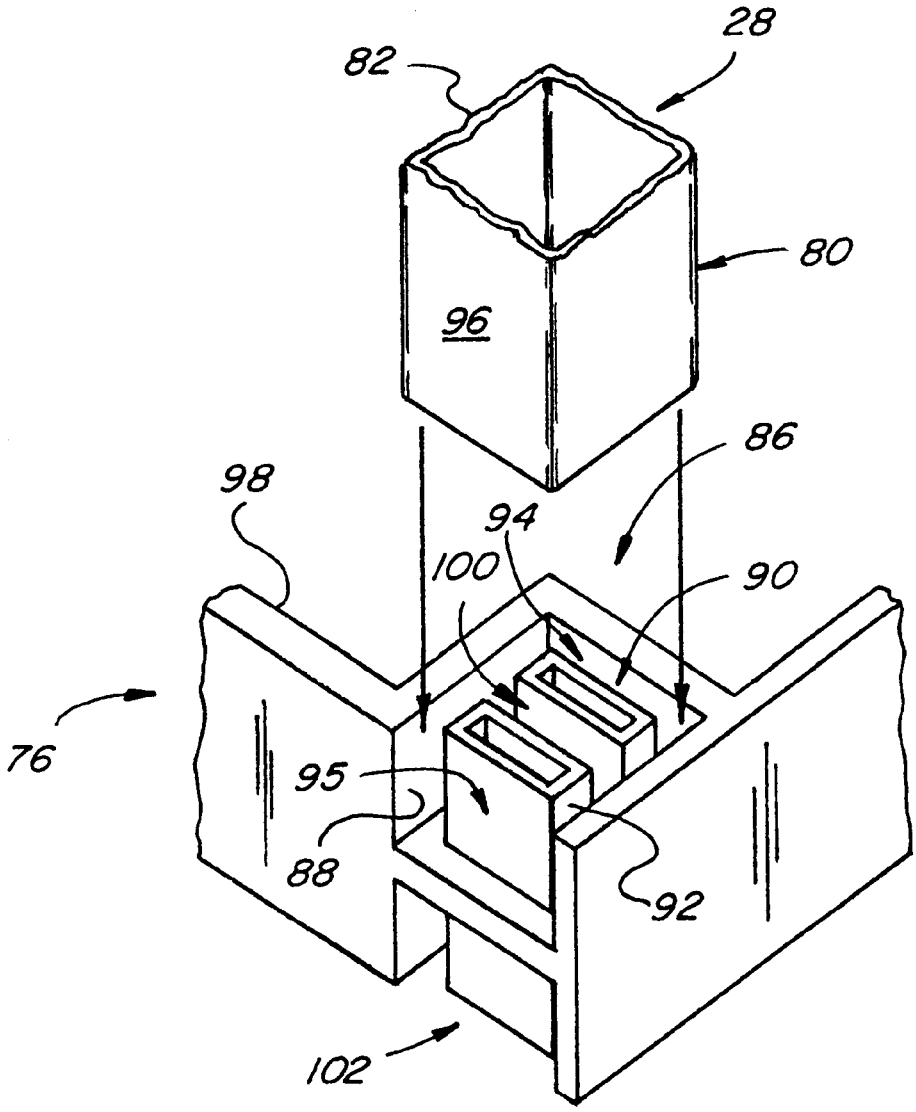
FIG. 5 is an exploded fragmentary view of another embodiment of a shelf member constructed in accordance with the teachings of the present invention.

Referring to FIG. 5, in an alternate embodiment, a shelf member 76 is provided wherein the full sockets 24 and 60, and the partial sockets 26 and 72, are replaced with a plurality of split full sockets 86 each of which is comprised of two juxtaposed half sockets. With two half sockets placed side-by-side, the split socket 86 is configured to receive the same support member 28 in two different orientations. The integrally formed split socket 86 includes an outer wall 88 extending around two spaced inserts 90 and 92 to define split channels 94 and 100 in the shape of the numeral eight (8) having an outer portion 95 creating an opening in the side wall 98 of the shelf member. The outer perimeter portion of the split channel 94 is sized to receive the outer dimensions of the support member 28 such that when the member 28 is inserted in the channel 94 as illustrated in FIG. 5, the outer wall surface 96 of the support member 28 will be flush with the side wall 98 of the shelf member. The intermediate split channel 100 is spaced from the side wall 98 a sufficient distance such that when the wall 82 of the support member 28 is inserted into the intermediate channel 100 substantially half of the support member is within the socket 86 and the remaining portion is exterior of the socket 86. As a result, when two shelf members 76 are positioned in side-by-side relationship such that adjacent sockets 86 are in abutting relationship with each other, the end portion 80 of the support member 28 can be positioned within the adjacent sockets 86 such that the opposed outer wall surfaces 96 lie within the respective channels 100. This allows the two adjacent shelf members 76 to be connected in side-by-side relationship similar to the connection described above with respect to the use of sockets 26 and 72 in FIGS. 2–4. The sockets 86 can therefore be used to both stackably connect any number of shelf members 76 one above the other in a vertical arrangement and to horizontally connect adjacent shelf members 76 to achieve a particular side-by-side configuration using the same standard support members 28. As with the previous embodiment, there are preferably four upper split sockets 86 and four lower split sockets 102, the sockets 102 being substantially similar in construction to sockets 86 and being in axial or opposed alignment therewith substantially at the corners of the shelf member 76. In addition, it is recognized and anticipated that the channel configuration associated with split sockets 86 and 102 can be varied and can take on a wide variety of different configurations without departing from the spirit and scope of the present invention.

Referring again to FIG. 2, an optional generally T-shaped securement tab 36 may be integrally formed with the shelf members 22 and 23 on the side wall 32 for mating with a correspondingly shaped securement slot 38 defined in a side wall 32 of an opposed and adjacent shelf member 22 or 23. The tab 36 preferably extends along substantially the entire height of the side wall 32. The securement slot 38 may likewise be integrally formed within the side wall of the adjacent shelf member 22 or 23, and the tab 36 is received within the slot 38 to secure the two adjacent shelf members together. The slot 38 also preferably extends along substantially the entire height of the side wall 32. Although any member of corresponding tabs and slots 36 and 38 may be optionally used in association with opposed side walls 32, it is generally preferred that either a tab 36 or a slot 38 be provided adjacent each corner associated with each opposed side wall 32. As illustrated in FIGS. 1 and 2, the tabs 36 and slots 38 are spaced from the corners by the length of the full and partial sockets 24 and 26 with the full socket 24 being closest to the corner. In this regard, the tabs and slots 36 and 38 may be positioned and located anywhere along the length of the side wall 32 between the respective corners.

Each tab 36 also includes a pair of extensions or legs 39 which are tapered inwardly in the downward direction at an angle of approximately 2° relative to the vertical. In similar fashion, each slot 38 includes a pair of correspondingly shaped extensions or legs 41 which are similarly tapered to receive the legs 39 of the tab 36. To join the shelf members 22 and 23, the respective tabs 36 are inserted into the corresponding slots 38 from the top. The tab legs 39 are received into the slot legs 41 and, due to the taper associated with legs 39 and 41, the tab 36 can not pass all the way through the slot 38, but instead, properly mates therewith. The tabs 36 and slots 38 therefore mate to align adjacent shelf members in substantially the same horizontal plane and provide additional securement means for holding adjacent shelf members in a side-by-side arrangement.

Figure 7:
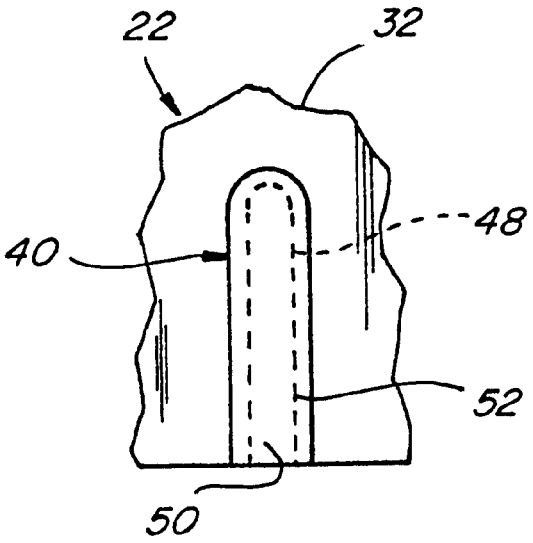
FIG. 7 is a fragmentary front view of a keeper member constructed according to the present invention.
Figure 8:
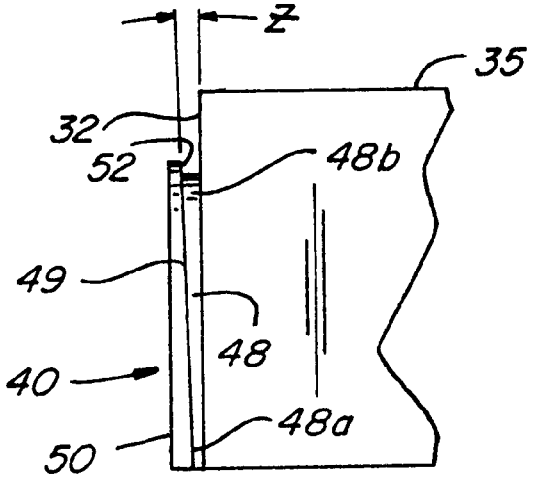
FIG. 8 is a fragmentary side view of the keeper member of FIG. 7.
Figure 9:
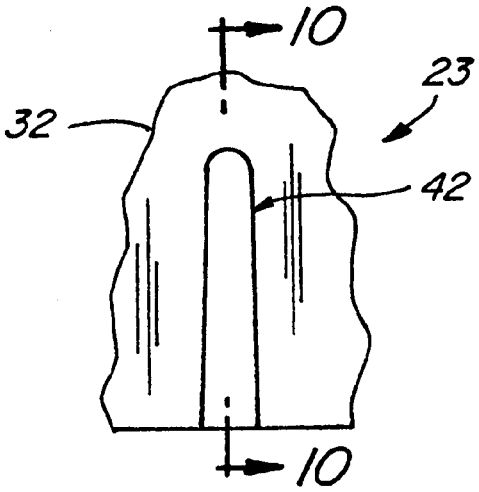
FIG. 9 is a fragmentary front view of a keeper slot for receiving the keeper member of FIG. 7.
Figure 10:
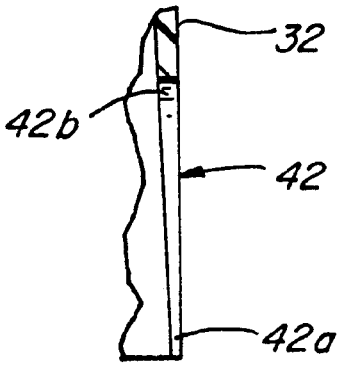
FIG. 10 is a fragmentary cross sectional view of the keeper slot of FIG. 9 taken along line 10—10 in FIG. 9.

Referring to FIGS. 7–10, the shelf members 22 and 23 may alternatively optionally include keeper members 40 and keeper slots 42 formed on and in the side wall 32. Each keeper 40 comprises a somewhat modified T-shaped projection which includes a base or stem portion 48 and an overhanging flange portion 50. The keeper is elongated in shape, and the base or stem portion 48 is outwardly tapered along its entire length from the bottom of the side wall 32 toward its terminal end portion such that the lower portion 48*a* thereof is thinner than its respective top portion 48*b*. In other words, the outer lateral mating surface 49 between the keeper portions 48 and 50 forms an angle Z with the vertically oriented side portion of the side wall of the shelf member. The keeper flange portion 50 overhangs the keeper portion 48 forming a somewhat U-shaped lipped portion 52 which surrounds the base or stem portion 48 on all sides as best seen in FIG. 7. The lip portion 52 forms a somewhat angular slot between the side wall 32 and the lip portion 52 which is compatible for receiving the corresponding slot 42 associated with the adjacent shelf member 22 or 23. When the two adjacent shelf members 22 and 23 are coupled together, the lip portion 52 abuts the inner side wall portion of the corresponding slot 42 to inhibit the keeper 40 from disengaging from the keeper slot 42.

The thickness of the wall portion forming the slot 42 is likewise tapered such that the thickness of the wall portion forming such slot 42 is thinner at its bottom portion 42*a* as compared to its top portion 42*b*. This means that as the slot 42 is engaged with the elongated keeper base portion 48 and is moved progressively downwardly toward the lower surface of the shelf member, the taper associated with the stem portion 48 as well as the varying thickness of the side wall 32 forming the slot 42 will enable the slot 42 to become progressively tighter as it is moved downwardly therealong. This double taper effect ensures a tight, strong, snug, and stable connection between the keeper member 40 and the keeper slot 42 when adjacent shelf members are coupled together. When coupled, the overlapping lip portion 52 likewise ensures that two adjacent shelf members will not become disengaged from each other by exerting a sideward pulling force thereagainst. Disengagement can only be accomplished by slidably moving one coupled shelf member vertically relative to the other. The keepers 40 are preferably integrally formed adjacent the lower portion of side wall 32. The interlocking keepers 40 and slots 42 have broad applicability. An additional application of the interlocking keepers and slots is disclosed is U.S. Pat. No. 5,624,042 which is hereby fully incorporated herein by reference.

Referring back to FIGS. 1–4, in assembling one of the display units 20 and attaching it to an adjacent display unit 20, bottom shelf member 22A is aligned with the adjacent bottom shelf member 23A on one side thereof in substantially the same horizontal plane in a side-by-side relationship as shown such that the respective partial sockets 26 and 72 are aligned and in abutting relationship with each other. If the shelf members include the keeper members 40 and the keeper slots 42 or the securement tabs 36 and slots 38, the shelf members are aligned by mating these components as well. Four of the elongated support members 28 are then inserted into the upper full sockets 24 associated with the outer perimeter of the adjacent shelf members. Attachment members, preferably two additional elongated support members 28, are attached to the aligned pairs of the upper partial sockets 26 thereby joining the bottom shelf members 22A and 23A in side-by-side relationship. Middle shelf members 22B and 23B are then aligned in a substantially horizontal plane in a side-by-side relationship on one side thereof to align the lower partial sockets 72 in abutting relationship with each other. The upper end portions of the four outer elongated support members are attached to the outer perimeter lower full sockets 60, and the upper end portions of the interior support members are attached to the aligned pairs of the lower partial sockets 72 thereby joining the middle shelf members 22B and 23B in side-by-side relationship. To add shelf members 22C, 23C, 22D and 23D to the display units, the assembly steps for attaching shelf members 22B and 23B are repeated. If desired, the above described alternative attachment members could likewise be used to attach the upper aligned pairs of partial sockets 26 associated with top shelf members 22D and 23D. The alternative attachment members could likewise be used to attach the abutting pairs of the upper and lower partial sockets 26 and 72 associated with shelf members 22A and 23A, 22B and 23B, and 22C and 23C. In this case, support members 28 would also be engaged with the respective full sockets 24 associated with each shelf member 22 and 23 to achieve the spaced vertical configuration. Additional shelf members 22 and 23 can be attached to the units illustrated in FIG. 1 in a similar manner to achieve any vertical and horizontal arrangement.

Referring to FIG. 5, the method of assembling a display unit using the alternate shelf members 76 is similar to the above described method and will be described only to the extent that such method is different from the above discussed method. To join adjacent shelf members 76, support members 28 are inserted into the outside loop of the numeral eight (8) shaped channel 94 associated with the outer perimeter sockets 86 such that the support members 28 receive both of the inserts 90 and 92 into each of the support member end portions 80. Support members 28 are then inserted into the aligned pairs of adjacent split sockets 86 with their respective opposite sides being received into the respective intermediate channels 100 thereby joining the adjacent shelf members 76 in side-by-side relationship. To add additional shelf members 76 to the display unit, the upper end portions of the support members 28 are attached to the lower sockets 102 in a similar manner as described with respect to upper sockets 86. Any number of additional shelf members 76 can be attached as explained above to achieve any vertical and horizontal arrangement.

Figure 11:
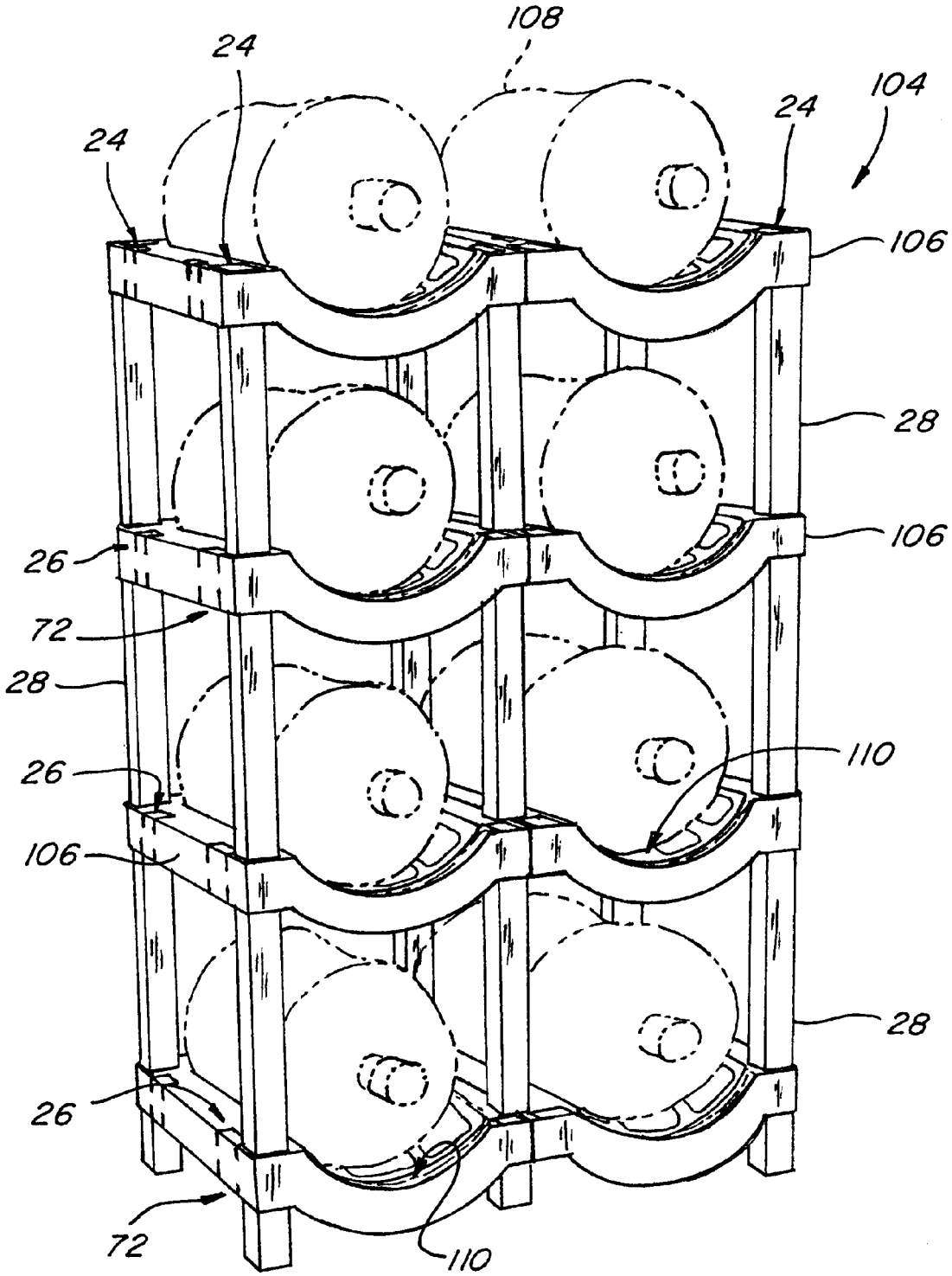
FIG. 11 is a perspective view of another embodiment of a shelf member and associated interconnected display units constructed and assembled in accordance with the teachings of the present invention.
Figure 12:
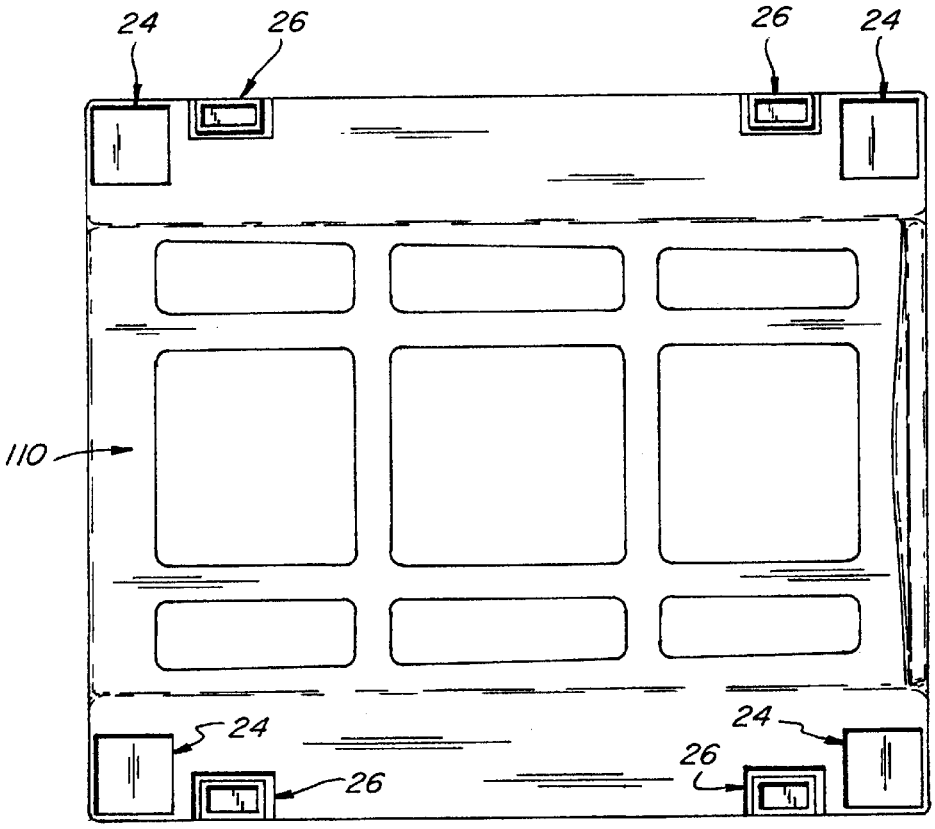
FIG. 12 is a top plan view of one of the shelf members of FIG. 11.
Figure 13:
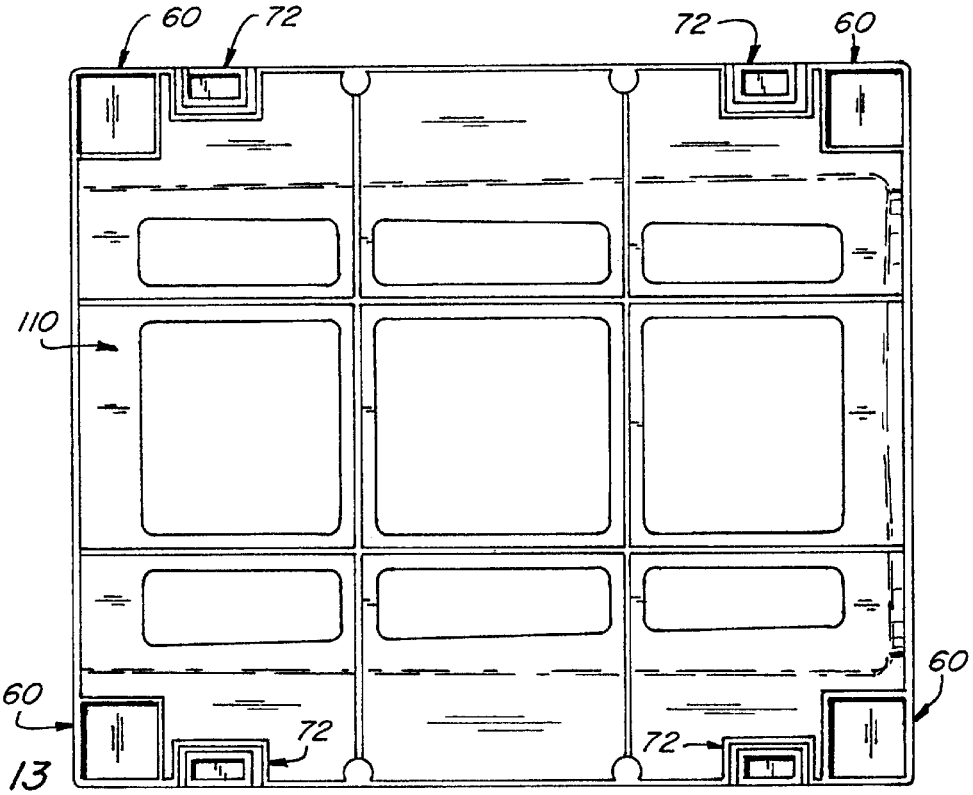
FIG. 13 is a bottom plan view of one of the shelf members of FIG. 11.

FIGS. 11–14 illustrate another application 104 wherein the partial sockets 26 and 72 are used in association with a plurality of shelf members 106, each shelf member 106 being specifically designed to hold and accommodate a typical water cooler type bottle 108. Similar to shelf members 22 and 23, each shelf member 106 includes a plurality of spaced apart full sockets 24 and a plurality of spaced apart partial sockets 26 which are interconnected by a plurality of support members 28 received within the sockets 24 and/or 26 as illustrated in FIG. 11. As best shown in FIGS. 12 and 13, each shelf member 106 also includes a product support area 110 which is contoured or otherwise correspondingly shaped so as to hold and support the substantially cylindrical shape of the water bottle 108. As best shown in FIG. 12, the upper full and partial sockets 24 and 26 are configured and arranged such that the support members 28 may be used to attach vertically adjoining shelf members using the full sockets 24 and adjacent shelf members using the partial sockets 26. The construction and operation of the sockets 24 and 26 are as previously explained with respect to the embodiment illustrated in FIGS. 1–4.

Figure 14:
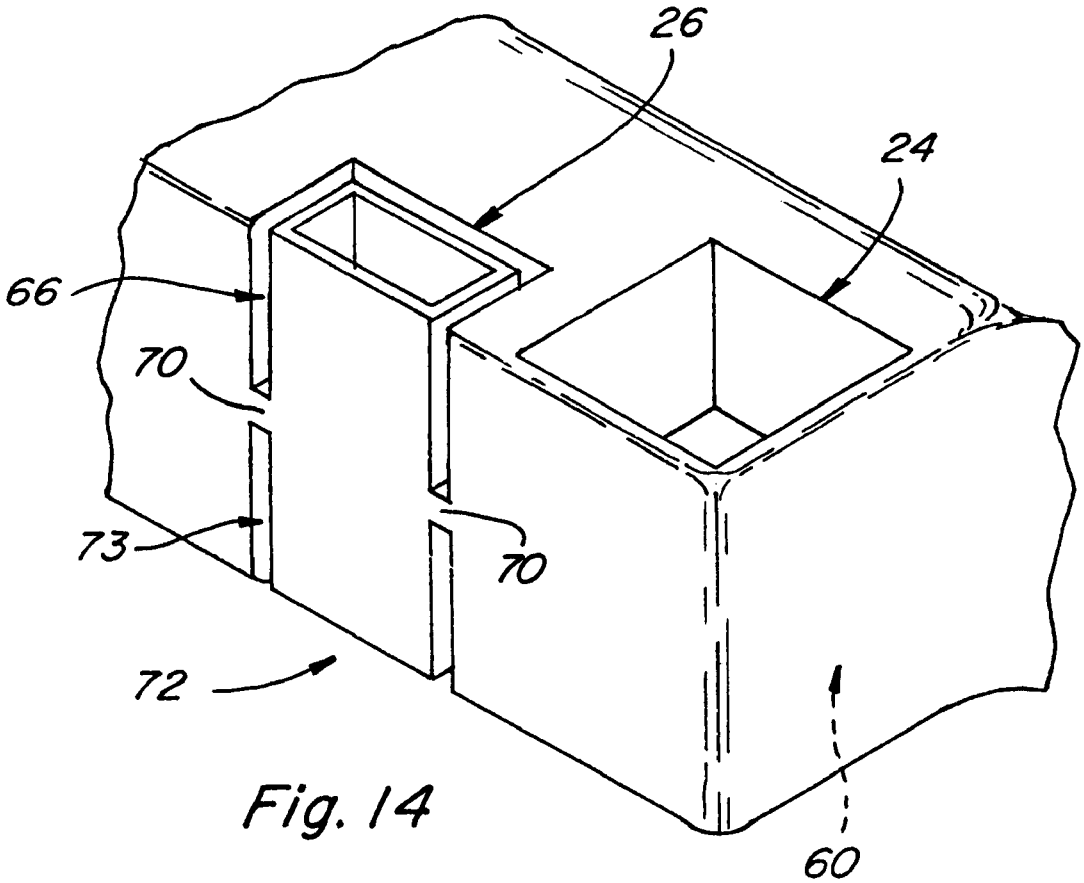
FIG. 14 is a fragmentary perspective view of a portion of one of the shelf members of FIG. 11 showing the positioning and location of the full and partial sockets associated therewith.

As best illustrated in FIG. 13, the bottom portion of shelf member 106 likewise includes a plurality of lower full sockets 60 which are positioned in axial or opposed alignment with the upper sockets 24, and a plurality of lower half or partial sockets 72 which are likewise positioned in axial or opposed alignment with the upper partial sockets 26 such that the separation member 70 again separates the upper channel socket 66 from the lower channel socket 73 (FIG. 14). Here again, the lower full socket 60 and lower partial sockets 72 are constructed and function as previously described with respect to the embodiment illustrated in FIGS. 1–4.

As best illustrated in FIG. 11, the shelf members 106 and support members 28 are interconnected to both vertically stack the shelf members in a spaced apart relationship as well as to horizontally arrange the shelf members 106 in a side-by-side configuration as shown. This vertical and horizontal configuration is achieved in a similar manner as previously explained with respect to the embodiment illustrated in FIG. 1. In this regard, the support members 28 are attached to the outer perimeter upper and lower full sockets 24 whereas the support members 28 associated the middle portion of the display unit 104 are attached to the aligned pairs of upper and lower partial sockets 26 and 72 as previously explained.

It is also recognized and anticipated that the split socket arrangement 86 illustrated in FIG. 5 could likewise be utilized in association with shelf members 106 and that attachment of adjacent shelf members, both vertically and horizontally, could be accomplished in the same manner as previously described with respect to socket 86 illustrated in FIG. 5.

It is also important to note that the overall dimensions of the present units 20 and 104 as well as the particular configuration of the individual shelf members 22, 23, 76 and 106, the support members 28, and the sockets 24, 26, 60, 72 and 86 are all subject to wide variations and each of the elements associated with the various embodiments of the present invention may be sized and shaped into a variety of different sizes and configurations to accommodate different display applications, different product sizes and shapes, and to conform with any space limitations without impairing the teachings and practice of the present constructions. Although the present invention has particular utility in a merchandising environment for storing and merchandising a multiplicity of shelved products such as a wide variety of soft drink products and other types of packaged and/or canned products, its simplicity, durability, flexibility and versatility greatly increases its usefulness and effectiveness in a wide variety of other applications. Also, because of its modular capability, the present display units have utility in furniture applications and can be utilized as pool side furniture, modular shelving for use in association with radio, television, stereo and VCR equipment as well as other furniture and wall system applications. Importantly, the present invention utilizes substantially identical support members 28 to both vertically and horizontally arrange the shelf members associated therewith to achieve a wide variety of modular configurations.

It is also recognized and anticipated that any number of the upper and lower partial sockets 26 and 72 could be utilized in association with any number or all sides of a particular shelf member so as to increase its modular side-by-side capabilities in multiple directions.

Thus, there has been shown and described several embodiments of a shelf member and display unit which utilizes partial sockets 26 and 72 and split sockets 86 to join adjacent shelf members in both a vertical spaced apart arrangement and a horizontal side-by-side arrangement using standard support members to achieve the modular capability, which shelf members and display units fulfil all of the objects and advantages sought therefore. While preferred embodiments and particular applications of the present invention have been shown and described, it is apparent that many other changes, modifications, variations and other uses and applications of the present constructions will become apparent to those skilled in the art after considering this specification and the accompanying drawings. All such changes, modifications, variations and other uses and applications which do not depart from the spirit and scope of the present invention are deemed to be covered by the invention which is limited only by the claims which follow.

What is claimed is:

1. A shelf member for use in a display unit for accommodating the storage of products thereon comprising:

an upper shelf portion, a lower shelf portion, and a floor portion for positioning products thereon;

a plurality of upper full sockets associated with said upper shelf portion, each of said upper full sockets being configured to receive one end portion of an elongated support member for attaching said shelf member to a substantially similarly constructed shelf member positioned in spaced apart relationship above said shelf member;

a plurality of lower full sockets associated with said lower shelf portion, each of said lower full sockets being configured to receive one end portion of an elongated support member for attaching said shelf member to a substantially similarly constructed shelf member positioned in spaced apart relationship below said shelf member; and at least one partial socket separate and apart from said plurality of upper and lower full sockets associated with said shelf member and configured to receive at least a portion of an attachment member for attaching said shelf member to a substantially similarly constructed shelf member positioned in side-by-side relationship adjacent said shelf member, the at least one partial socket associated with each adjacent shelf member being positioned in abutting relationship to each other, said abutting partial sockets being adapted to receive the attachment member.

2. The shelf member according to claim 1 wherein said at least one partial socket is configured to receive at least a portion of one end portion of an elongated support member, the elongated support member comprising the attachment member for attaching two of said shelf members in side-by-side relationship adjacent each other.

3. The shelf member according to claim 2 wherein said at least one partial socket includes an outer wall and an inner wall which define a socket channel therebetween, said socket channel being adapted to receive at least a portion of one end portion of an elongated support member.

4. The shelf member according to claim 3 wherein said socket channel comprises a substantially U-shaped channel.

5. The shelf member according to claim 1 wherein said shelf member includes a plurality of upper partial sockets associated with said upper shelf portion and a plurality of lower partial sockets associated with said lower shelf portion.

6. The shelf member according to claim 5 wherein said plurality of upper partial sockets are positioned in opposed alignment with said plurality of lower partial sockets.

7. The shelf member according to claim 1 wherein said floor portion is substantially rectangular in shape, said plurality of upper and lower full sockets being respectively positioned and located at approximately the respective corners of said shelf member, said at least one partial socket being positioned adjacent a selected one of said upper and lower full sockets such that said selected full socket separates said at least one partial socket from a respective corner of said shelf member.

8. The shelf member according to claim 1 wherein said shelf member is configured to hold a substantially cylindrical container.

9. A shelf member for use in a display unit for accommodating the storage of products thereon comprising:

an upper shelf portion, a lower shelf portion, and a floor portion for positioning products thereon;

a plurality of upper full sockets associated with said upper shelf portion and a plurality of lower full sockets associated with said lower shelf portion, each of said upper and lower full sockets being configured to receive one end portion of an elongated support member for attaching said shelf member in spaced vertical relationship to a substantially similarly constructed shelf member;

a plurality of upper partial sockets associated with said upper shelf portion and a plurality of lower partial sockets associated with said shelf lower portion, said plurality of upper and lower partial sockets being configured to receive at least a portion of one end portion of an elongated support member for attaching said shelf member in side-by-side horizontal relationship to a substantially similarly constructed shelf member;

at least some of said upper and lower partial sockets associated with one of said shelf members being positioned in abutting relationship with at least some of the upper and lower partial sockets associated with another one of said shelf members when two of said shelf members are positioned in side-by-side horizontal relationship to each other, said abutting upper and lower partial sockets in combination being adapted to receive one end portion of the elongated support member.

10. The shelf member according to claim 9 wherein said plurality of upper full sockets are positioned in opposed alignment with said plurality of lower full sockets.

11. The shelf member according to claim 9 wherein said plurality of upper partial sockets are positioned in opposed alignment with said plurality of lower partial sockets.

12. The shelf member according to claim 11 wherein each of said aligned pairs of upper and lower partial sockets is separated by an intermediate wall member positioned therebetween.

13. The shelf member according to claim 9 wherein each of said upper and lower partial sockets includes a channel adapted to receive at least a portion of one end portion of an elongated support member.

14. The shelf member according to claim 9 wherein said shelf member is substantially rectangular in shape, said plurality of upper and lower full sockets being respectively positioned and located at approximately the respective corners of said shelf member, each of said plurality of upper and lower partial sockets being respectively positioned adjacent a selected one of said upper or lower full sockets.

15. The shelf member according to claim 9 including cooperatively engagable means associated with said shelf member for enabling said shelf member to be further coupled together in a side-by-side horizontal relationship with a substantially similarly constructed shelf member.

16. The shelf member according to claim 15 wherein said cooperatively engagable means includes at least one securement tab and at least one securement slot associated with said shelf member, the securement tab of said shelf member cooperatively engaging the securement slot of a substantially similarly constructed shelf member when said two shelf members are positioned in side-by-side horizontal relationship to each other.

17. The shelf member according to claim 15 wherein said cooperatively engagable means includes at least one elongated keeper member and at least one keeper slot associated with said shelf member, the keeper member of said shelf member for cooperatively engaging the keeper slot of a substantially similarly constructed shelf member when said two shelf members are positioned in side-by-side horizontal relationship to each other.

18. A display unit for accommodating the storage of products thereon comprising:

a plurality of substantially similar shelf members each having an upper and lower portion and a floor portion extending therebetween for positioning products thereon;

a plurality of elongated support members having opposed end portions;

a plurality of upper full sockets associated with the upper portion of each of said shelf members and a plurality of lower full sockets associated with the lower portion of each of said shelf members, said plurality of upper and lower full sockets being positioned at spaced locations on the respective upper and lower portions of said shelf members, each of said upper and lower full sockets being cooperatively engagable with the opposed end portions of said elongated support members for permitting said shelf members to be vertically stackably arranged in spaced apart relationship one above the other;

a plurality of upper partial sockets associated with the upper portion of each of said shelf members and a plurality of lower partial sockets associated with the lower portion of each of said shelf members, said plurality of upper and lower partial sockets being positioned at spaced locations on the respective upper and lower portions of said shelf members, each of said upper and lower partial sockets being cooperatively engagable with at least a portion of the opposed end portions of said elongated support members to permit said shelf members to be joined in side-by-side relationship one adjacent the other when at least some of said upper and lower partial sockets associated with one of said shelf members are positioned in abutting relationship with at least some of the upper and lower partial sockets associated with an adjacently positioned shelf member;

the opposed end portions of each of said elongated support members being cooperatively engagable with the abutting upper and lower partial sockets associated with the adjacently positioned shelf members.

19. The display unit according to claim 18 wherein the floor portion associated with at least some of said shelf members is configured to hold a substantially cylindrical container.

20. The display unit according to claim 18 wherein said plurality of upper full sockets are positioned in opposed alignment with said plurality of lower full sockets and wherein said plurality of upper partial sockets are positioned in opposed alignment with said plurality of said lower partial sockets.

21. The display unit according to claim 18 wherein each of said upper and lower partial sockets includes a channel for cooperatively engaging at least a portion of the opposed end portions of said elongated support members, said channel being positioned and located with respect to each of said upper and lower partial sockets such that the respective channels associated with two abutting upper or lower partial sockets will cooperatively receive opposed end portions of said elongated support members, a portion of the opposed end portions of said elongated support members being engaged with one of said abutting upper or lower partial sockets and the remaining portion of the opposed end portions of said elongated support members being cooperatively engaged with the other abutting upper or lower partial socket.

22. The display unit according to claim 18 wherein each of said shelf members further includes at least one securement tab for cooperatively engaging at least one corresponding securement slot when two of said shelf members are positioned in side-by-side relationship to each other, said at least one securement tab and said at least one securement slot enabling two adjacent shelf members to be further coupled together in side-by-side horizontal relationship.

23. The display unit according to claim 22 wherein said at least one securement tab is generally T-shaped in configuration and wherein said at least one securement slot is correspondingly shaped to receive said T-shaped securement tab.

24. The display unit according to claim 23 wherein at least a portion of said T-shaped tab and its correspondingly shaped receiving slot is tapered to prevent the securement tab from passing all the way through said securement slot.

25. The display unit according to claim 18 wherein each of said shelf members includes at least one elongated keeper member for cooperatively engaging at least a corresponding keeper slot when two of said shelf members are positioned in side-by-side relationship adjacent to each other, said at least one keeper member and said at least one corresponding keeper slot enabling two adjacent shelf members to be further coupled together in side-by-side horizontal relationship.

26. The display unit according to claim 25 wherein each of said shelf members includes at least one side wall, said at least one keeper slot being cut into the respective side wall of said shelf members such that the thickness of the side wall forming said keeper slot is thinner at the respective lower portion as compared to the respective upper portion, said at least one keeper member including a stem portion and an overhanging flange portion, the flange portion being tapered in a direction which extends outwardly away from the side wall along its entire length from its lower portion to its upper terminal end portion such that the mating surface between the stem portion and the overhanging flange portion forms an angle with the side wall of said shelf members, the taper associated with the stem portion causing the thickness of the stem portion to be thinner at its lower portion as compared to its upper end portion, the taper associated with the keeper stem portion in conjunction with the variation and thickness associated with the keeper slot enabling the keeper member and its corresponding keeper slot to become progressively tighter thereby drawing adjacent shelf members closer together as the keeper slot is moved progressively downwardly over the keeper stem portion.

27. A shelf member for use in a display unit for accommodating the storage of products thereon, the shelf member comprising:

an upper portion, a lower portion, and a floor portion for positioning products thereon;

a plurality of upper split sockets associated with said upper portion, each of said upper split sockets being configured to receive one end portion of an elongated support member in two different orientations for attaching said shelf member to a substantially similarly constructed shelf member positioned either in a spaced apart relationship above said shelf member or in a side-by-side horizontal relationship adjacent thereto;

a plurality of lower split sockets associated with said lower portion, each of said lower split sockets being configured to receive one end portion of an elongated support member in two different orientations for attaching said shelf member to a substantially similarly constructed shelf member positioned either in a spaced apart relationship below said shelf member or in a side-by-side horizontal relationship adjacent thereto.

28. The shelf member according to claim 27 wherein said plurality of upper split sockets are positioned in opposed alignment with said plurality of lower split sockets.

29. The shelf member according to claim 27 wherein each of said upper and lower split sockets include a split channel, the one end portion of an elongated support member being received in one orientation within said split channel in order to vertically stackably arrange said shelf member in spaced apart relationship to another substantially similarly constructed shelf member, the one end portion of an elongated support member being received in another orientation within said split channel to both vertically stackably arrange said shelf member in spaced apart relationship to another substantially similarly constructed shelf member and to horizontally arrange said shelf member to another substantially similarly constructed shelf member in side-by-side relationship one adjacent the other, at least some of said upper or lower split sockets associated with adjacent shelf members being positioned in abutting relationship with each other to complete the attachment.

30. The shelf member according to claim 29 wherein each of said split channels is in the general shape of the numeral eight.

31. The shelf member according to claim 27 wherein said floor portion is configured to hold a substantially cylindrical container.

32. A display unit for accommodating the storage of products thereon comprising:

a plurality of substantially similar shelf members, each of said shelf members having an upper portion, a lower portion, and a floor portion for positioning products thereon;

a plurality of elongated support members having opposed end portions;

a plurality of split sockets associated with the upper portion of each of said shelf members and a plurality of split sockets associated with the lower portion of each of said shelf members, said plurality of upper and lower split sockets being positioned at spaced locations on the respective upper and lower portions of said shelf members;

each of said upper and lower split sockets being configured to cooperatively engage at least a portion of the opposed end portions of said elongated support members in two different orientations;

in one orientation, at least some of said plurality of elongated support members are positioned and arranged so as to engage at least some of the upper and lower split sockets associated with at least two shelf members to permit said shelf members to be vertically stackably arranged in spaced apart relationship one above the other;

in another orientation, at least some of said plurality of elongated support members are positioned and arranged so as to engage at least some of the upper and lower split sockets associated with at least two shelf members positioned in side-by-side relationship to each other to permit said shelf members to be arranged in substantially the same horizontal plane one adjacent the other.

33. The display unit according to claim 32 wherein adjacent shelf members are positioned and located such that at least some of said upper or lower split sockets are positioned in abutting relationship to each other, at least a portion of an opposed end portion of said elongated support members being engagable with one of said abutting upper or lower split sockets and the remaining portion of an opposed end portion of said elongated support members being engagable with the other abutting upper or lower split socket.

34. The display unit according to claim 32 wherein said plurality of upper split sockets are positioned in opposed alignment with said plurality of lower split sockets.

35. The display unit according to claim 32 wherein each of said upper and lower split sockets includes a channel configuration allowing the opposed end portions of said elongated members to be contained within the perimeter of each of said shelf members in one orientation thereof, and said channel configuration allowing at least a portion of the opposed end portions of said elongated support members to extend beyond the perimeter of each of said shelf members in the other orientation thereof.

36. The display unit according to claim 35 wherein said channel configuration includes a split channel generally in the shape in the numeral eight.

37. A method for assembling a display unit including first and second bottom shelf members, first and second top shelf members, and a plurality of elongated support members, wherein each of said shelf members includes a plurality of upper and lower full sockets and a plurality of upper and lower partial sockets, the method comprising:

aligning, in substantially the same plane, the first and second bottom shelf members in side-by-side relationship on one side thereof to align the upper partial sockets of the first bottom shelf member with the upper partial sockets of the second bottom shelf member so as to form upper aligned pairs of the upper partial sockets;

attaching one end portion of the elongated support members to the upper full sockets associated with the outer perimeter of the first and second bottom shelf members;

attaching one end portion of additional elongated support members to the upper aligned pairs of the upper partial sockets of the first and second bottom shelf members thereby joining the first and second bottom shelf members;

aligning, in substantially the same plane, the first and second top shelf members in side-by-side relationship on one side thereof to align the lower partial sockets of the first top shelf member with the lower partial sockets of the second top shelf member so as to form lower aligned pairs of the lower partial sockets;

attaching the opposite end portion of the elongated support members attached to the outer perimeter of the first and second bottom shelf members to the lower full sockets associated with the outer perimeter of the first and second top shelf members; and attaching the opposite end portion of the additional elongated support members attached to upper aligned pairs of the upper partial sockets of the first and second bottom shelf members to the lower aligned pairs of the lower partial sockets of the first and second top shelf members thereby joining the first and second top shelf members to the first and second bottom shelf member.

38. The method according to claim 37 further comprising:

providing a third top shelf member and a third bottom shelf member;

aligning, in substantially the same plane, the third bottom shelf member with the first bottom shelf member in side-by-side relationship on one side thereof to align the upper partial sockets of the first bottom shelf member with the upper partial sockets of the third bottom shelf member so as to form additional upper aligned pairs of the upper partial sockets;

detaching the respective end portions of the elongated support members from the upper full sockets associated with the outer perimeter of the first bottom shelf member and from the corresponding lower full sockets associated with the outer perimeter of the first top shelf member;

attaching one end portion of the detached elongated support members to the upper aligned pairs of the upper partial sockets of the first and third bottom shelf members thereby joining the first and third bottom shelf members;

attaching one end portion of additional elongated support members to the upper full sockets associated with the outer perimeter of the third bottom shelf member;

aligning, in substantially the same plane, the first and third top shelf members in side-by-side relationship on one side thereof to align the lower partial sockets of the first top shelf member with the lower partial sockets of the third top shelf member so as to form additional lower aligned pairs of the lower partial sockets;

attaching the opposite end portion of the additional elongated support members attached to the outer perimeter of the third bottom shelf member to the lower full sockets associated with the outer perimeter of the third top shelf member; and attaching the opposite end portion of elongated support members attached to the upper aligned pairs of the upper partial sockets of the first and third bottom shelf members to the lower aligned pairs of the lower partial sockets of the first and third top shelf members thereby joining the first and third top shelf members to the first and third bottom shelf members.

39. A shelf member for use in a display unit for accommodating the storage of products thereon, the shelf member comprising:

an upper portion, a lower portion, and a floor portion for positioning products thereon;

a plurality of upper split sockets associated with said upper portion, each of said upper split sockets being configured to receive one end portion of an elongated support member in two different orientations for attaching said shelf member to a substantially similarly constructed shelf member positioned either in a spaced apart relationship above said shelf member or in a side-by-side horizontal relationship adjacent thereto;

a plurality of lower split sockets associated with said lower portion, each of said lower split sockets being configured to receive one end portion of an elongated support member in two different orientations for attaching said shelf member to a substantially similarly constructed shelf member positioned either in a spaced apart relationship below said shelf member or in a side-by-side horizontal relationship adjacent thereto, each of said upper and lower split sockets including a split channel, the one end portion of an elongated support member being received in one orientation within said split channel in order to vertically stackably arrange said shelf member in spaced apart relationship to another substantially similarly constructed shelf member, the one end portion of an elongated support member being received in another orientation within said split channel to both vertically stackably arrange said shelf member in spaced apart relationship to another substantially similarly constructed shelf member and to horizontally arrange said shelf member to another substantially similarly constructed shelf member in side-by-side relationship one adjacent the other, at least some of said upper or lower split sockets associated with adjacent shelf members being positioned in abutting relationship with each other to complete the attachment, each of said split channels being in the general shape of the numeral eight.

40. A display unit for accommodating the storage of products thereon comprising:

a plurality of substantially similar shelf members, each of said shelf members having an upper portion, a lower portion, and a floor portion for positioning products thereon;

a plurality of elongated support members having opposed end portions;

a plurality of split sockets associated with the upper portion of each of said shelf members and a plurality of split sockets associated with the lower portion of each of said shelf members, said plurality of upper and lower split sockets being positioned at spaced locations on the respective upper and lower portions of said shelf members;

each of said upper and lower split sockets being configured to cooperatively engage at least a portion of the opposed end portions of said elongated support members in two different orientations;

in one orientation, at least some of said plurality of elongated support members are positioned and arranged so as to engage at least some of the upper and lower split sockets associated with at least two shelf members to permit said shelf members to be vertically stackably arranged in spaced apart relationship one above the other;

in another orientation, at least some of said plurality of elongated support members are positioned and arranged so as to engage at least some of the upper and lower split sockets associated with at least two shelf members positioned in side-by-side relationship to each other to permit said shelf members to be arranged in substantially the same horizontal plane one adjacent the other, each of said upper and lower split sockets including a channel configuration allowing the opposed end portions of said elongated members to be contained within the perimeter of each of said shelf members in one orientation thereof, and said channel configuration allowing at least a portion of the opposed end portions of said elongated support members to extend beyond the perimeter of each of said shelf members in the other orientation thereof, said channel configuration including a split channel generally in the shape of the numeral eight.

* * * * *